US007147125B1

(12) United States Patent
Slovak et al.

(10) Patent No.: US 7,147,125 B1
(45) Date of Patent: Dec. 12, 2006

(54) COLLAPSIBLE TRANSPARENT COOLER

(76) Inventors: David M Slovak, P.O. Box 2151, Umatilla, FL (US) 32784-2462; Roy E Bentley, II, 1810 N. Country Rd. 19A, Eustis, FL (US) 32726

( * ) Notice: Subject to any disclaimer, the term of this patent is extended or adjusted under 35 U.S.C. 154(b) by 346 days.

(21) Appl. No.: 10/680,398

(22) Filed: Oct. 7, 2003

(51) Int. Cl.
*B65D 88/00* (2006.01)
*B65D 25/54* (2006.01)
*B65D 8/14* (2006.01)

(52) U.S. Cl. ..... 220/592.2; 220/602; 220/4.31

(58) Field of Classification Search ..... 220/602, 220/592.2, 4.31, 4.32, 592.27, 4.09, 4.07, 220/812, 309.2, 592.01, 592.03, 592.05
See application file for complete search history.

(56) References Cited

U.S. PATENT DOCUMENTS 2,538,524 A * 1/1951 Joseph ..... 220/592.27
2,960,249 A * 11/1960 Walsh ..... 217/65
3,678,703 A 7/1972 Cornish et al.
4,024,731 A 5/1977 Branscum
5,259,215 A 11/1993 Rocca
5,505,307 A 4/1996 Shink
5,638,896 A 6/1997 Nishino et al.
5,918,478 A 7/1999 Bostic et al.
6,247,328 B1 6/2001 Mogil
6,415,928 B1 * 7/2002 Giacci ..... 206/781

* cited by examiner

*Primary Examiner*—Jes F. Pascua
*Assistant Examiner*—Shawn M. Braden
(74) *Attorney, Agent, or Firm*—Michael I. Kroll

(57) ABSTRACT

The invention is a collapsible transparent portable cooler with sides having two or more walls with air gaps positioned within the walls providing insulation properties and means for easily viewing the contents of the cooler from any angle. In addition to the obvious advantage to security personnel in being able to quickly screen the contents, the present invention provides envelopes on the sides and top of the cooler with the envelopes conforming substantially in size to its respective side or top. These can be easily inserted and removed through the access slots provided as needed.

17 Claims, 17 Drawing Sheets

COLLAPSIBLE TRANSPARENT COOLER

BACKGROUND OF THE INVENTION

1. Field of the Invention

The present invention relates generally to containers for holding materials for storage, more specifically, to a transparent cooler for storing perishable foods.

For many years coolers have been regularly used for all types of working and recreational occasions. Whether the cooler is being used to keep items cold or warm, we use coolers when we're working and when we're playing. They go with us to construction sites and sporting events. We toss them into pickup trucks and fishing boats.

Unfortunately, due to recent international events including threat of terrorism and other acts of violence, security measures have been tightened at many public events and venues. Safety and security for guests, employees, entertainers and players have always been a concern, but these recent events have prompted security measures that include exclusion or limitation of many items including the use of coolers from such venues. Many security measures include limiting the package size and type.

Commonly such venues have continued to accept transparent packages and coolers due to the ease and ability to inspect the contents in an expeditious way.

The present invention's transparent cooler meets the demands of the new security measures and provides the user improved means to maintain and store perishable foods. The construction of the present invention's cooler includes side panels and a top cover that are made of a transparent material that allows the user or others to view the contents within the cooler.

In addition to being transparent, the cooler can be disassembled into individual components. The side and end panels are detachable from the base to allow the user improved means to clean the cooler and to reduce the size while the cooler is not in use.

The sides of the cooler are comprised of interlocking tracks and channels. Each side panel has a T-track extending from one edge with a channel on the opposing end interior face whereby each edge T-track is inserted into the channel of the adjacent side panel. Once all side wall T-tracks and channels are mated the assembled side wall structure having a further channel located within the bottom edge is inserted onto the cooler base that has spaced apart T-tracks on opposing sides of the interior face. The mating wall seams are sealed by means of gaskets on both sides of the T-track In an additional preferred element in the construction of the present invention's end and side walls, a spaced apart panel forming an envelope is added whereby a sun blocking insulative and/or interchangeable decorative coverings can be inserted therein. The removable sun reflective panel can be inserted in any or all of the four sides and top creating an improved insulated barrier.

Artistically, the sun reflective panel may include pictorial or decorative coverings to suit the user or to reflect the venue (favorite team, player, or like).

In an additional preferred element in the construction of the present invention's end and side walls, the material is extruded to include a plurality of air gaps between the interior and exterior walls.

Still yet another additional element of the present invention includes an alternate construction of the transparent cooler utilizing a top mounted lifting handle in lieu of end panel handles. The handle is supported by adjustable straps that wrap each side and is secured with four-way receiver.

The receiver has a release button to enable user access to the cooler contents. The adjustable straps acts as both, means to secure the top cover and means to lift the cooler for transporting.

2. Description of the Prior Art

There are containers for holding materials for storage. Typical of these is U.S. Pat. No. 3,678,703 issued Edward Cornish on Jul. 25, 1972.

A patent was issued on May 24, 1977 as U.S. Pat. No. 4,024,731 to Tony E. Branscum. Another patent was issued to David D. Rocca on Nov. 9, 1993 as U.S. Pat. No. 5,259,215. Yet another U.S. Pat. No. 5,505,307 was issued to Joseph M. Shink on Apr. 9, 1996 and still yet another was issued on Jun. 17, 1997 to Yoshiya Nishino as U.S. Pat. No. 5,638,896.

U.S. Pat. No. 5,918,478 was issued William M. Bostic on Jul. 6, 1999. Another patent was issued to Melvin S. Mogil on Jun. 19, 2001 as U.S. Pat. No. 6,247,328. Yet another U.S. Pat. No. 6,415,928 was issued to William J. Giacci on Jul. 9, 2002.

U.S. Pat. No. 3,678,703

Inventor: Edward Cornish

Issued: Jul. 25, 1972

Container for holding material during storage or transportation in which the separable, insulated cover contains a body of heat-absorbing substance thermally exposed to the interior of the container through heat-conducting inside face of the cover, the cover being capable of being formed from a single piece of fiberboard or other sheet metal.

U.S. Pat. No. 4,024,731

Inventor: Tony E. Branscum

Issued: May 24, 1977

A refreezable container for a cold storage structure which can be releasably secured to the lid of the structure is the subject of the present invention. The container comprises yieldable spaced apart sidewalls which form an enclosure for holding a refreezable liquid. A passageway through the enclosure and its sidewalls receives an elongated stud. The stud has a gripping surface at one end and is threaded on the other end. Along the length of the stud a lateral projection extends outwardly so that the combined dimension of the projection and the stud is greater than the corresponding dimension of the passageway. The yieldable passageway walls permit insertion of the stud which may then be turned to screw the threaded stud into a correspondingly threaded receptacle in the lid of the cold storage structure.

U.S. Pat. No. 5,259,215

Inventor: David D. Rocca

Issued: Nov. 9, 1993

A cooler that allows for its transportability by the selective attachment to the cooler structure of axle and wheel assembly to the undercarriage of the cooler as desired. By the affixing to the undercarriage of the cooler mounting blocks that are capable of selectively receiving the axle portion of a wheel and axle assembly in rotational mechanical inter-fit, the features and advantages of the proposed invention are achieved.

U.S. Pat. No. 5,505,307

Inventor: Joseph M. Shink

Issued: Apr. 9, 1996

An insulated cooler which can be mounted to the floor of an automobile and provides access to open beverage containers. The cooler includes an insulated box which has a front wall separated from a back wall by a pair of side walls. The front, back and side walls are attached to a bottom wall that together define an inner cavity. The insulated cooler also has a top cover adapted to enclose the inner cavity of the box. The insulated box is small enough to be placed between the driver and front passenger of an automobile. The cooler has a strip of hook and loop material which can secure the bottom wall of the box to the carpet of the car. Additionally, the top cover has a pair of apertures adapted to receive beverage containers. The apertures may be covered by a flap which can be fastened to either the front or back walls of the box.

U.S. Pat. No. 5,638,896

Inventor: Yoshiya Nishino

Issued: Jul. 17, 1997

The present invention relates to a cold-hot storage box which can be used as a constant temperature box, a refrigerator for household use, or a freezer, and to a manufacturing method therefor. The cold-hot box of the present invention being characterized by the provision of an insulating container comprising a space of a double walled container made from an inner container and an outer container, enclosing at least one gas having low thermal conductivity selected from the group consisting of xenon, krypton, and argon.

U.S. Pat. No. 5,918,478

Inventor: William M. Bostic

Issued: Jul. 6, 1999

A lightweight, insulated chest and method are provided for transportation and storage of perishable and other items which require a temperature-controlled environment. The chest includes insulated side walls, bottom and a hinged cover which is pneumatically sealed to prevent tampering and for thermal security. The chest includes a fluid conduit within the cover for air evacuation and depressurization of the interior and also includes a conduit to provide a vacuum between the walls of the sides and bottom which contain a rigid polymeric foam insulation.

U.S. Pat. No. 6,247,328

Inventor: Melvin S. Mogil

Issued: Jun. 19, 2001

A portable soft sided insulated container has an impermeable liner that provides a liquid holding barrier. The liner is folded from a single monolithic plastic sheet to reduce or eliminate the need for heat welded seams. The liner seats within the container and has a releasable attachment around its lip for mating with the rim of the container. The container has an insulated lid so that the entire assembly may be closed. The liner can be removed for cleaning, or replacement if punctured. When not in use the entire assembly can be folded into a collapsed position for storage. The container has two storage chambers that share a common insulated dividing wall.

U.S. Pat. No. 6,415,928

Inventor: William J. Giacci

Issued: Jul. 9, 2002

A display container comprises a base having a planar supporting surface, the planar supporting surface being cant relative to horizontal along two orthogonal axes. The display container may also include a transparent cover disposed on the base, and a box foldingly enclosing the base and the transparent cover.

While these containers for holding materials for storage may be suitable for the purposes for which they were designed, they would not be as suitable for the purposes of the present invention, as hereinafter described.

SUMMARY OF THE PRESENT INVENTION

A primary object of the present invention is to provide a transparent container for holding materials for storage.

Another object of the present invention is to provide a transparent container with insulating means for holding perishable food items for storage.

Still another object of the present invention is to provide a transparent container with insulating means for holding hot materials for storage.

Yet another object of the present invention is to provide a transparent container with insulating means for holding cold materials for storage.

Still another object of the present invention is to provide a transparent container with means to disassemble the top cover, side walls, and end walls from the base.

Another object of the present invention is to provide a transparent container with means to have a sun reflective element contained within the walls of the container.

Yet another object of the present invention is to provide a transparent container with means to have a plurality of air spaces within the walls of the container.

Still another object of the present invention is to provide a transparent container that provides means for lifting from either the top cover or end panels.

Still another object of the present invention is to provide a transparent container that is cost effective to manufacture.

Additional objects of the present invention will appear as the description proceeds.

The present invention overcomes the shortcomings of the prior art by providing an improved means for holding materials for storage in transparent container that can be disassembled. In addition to providing means for holding materials for storage with removable sun reflecting elements. Furthermore, providing a transparent container with means for having a plurality of air gaps formed within the walls of the container.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
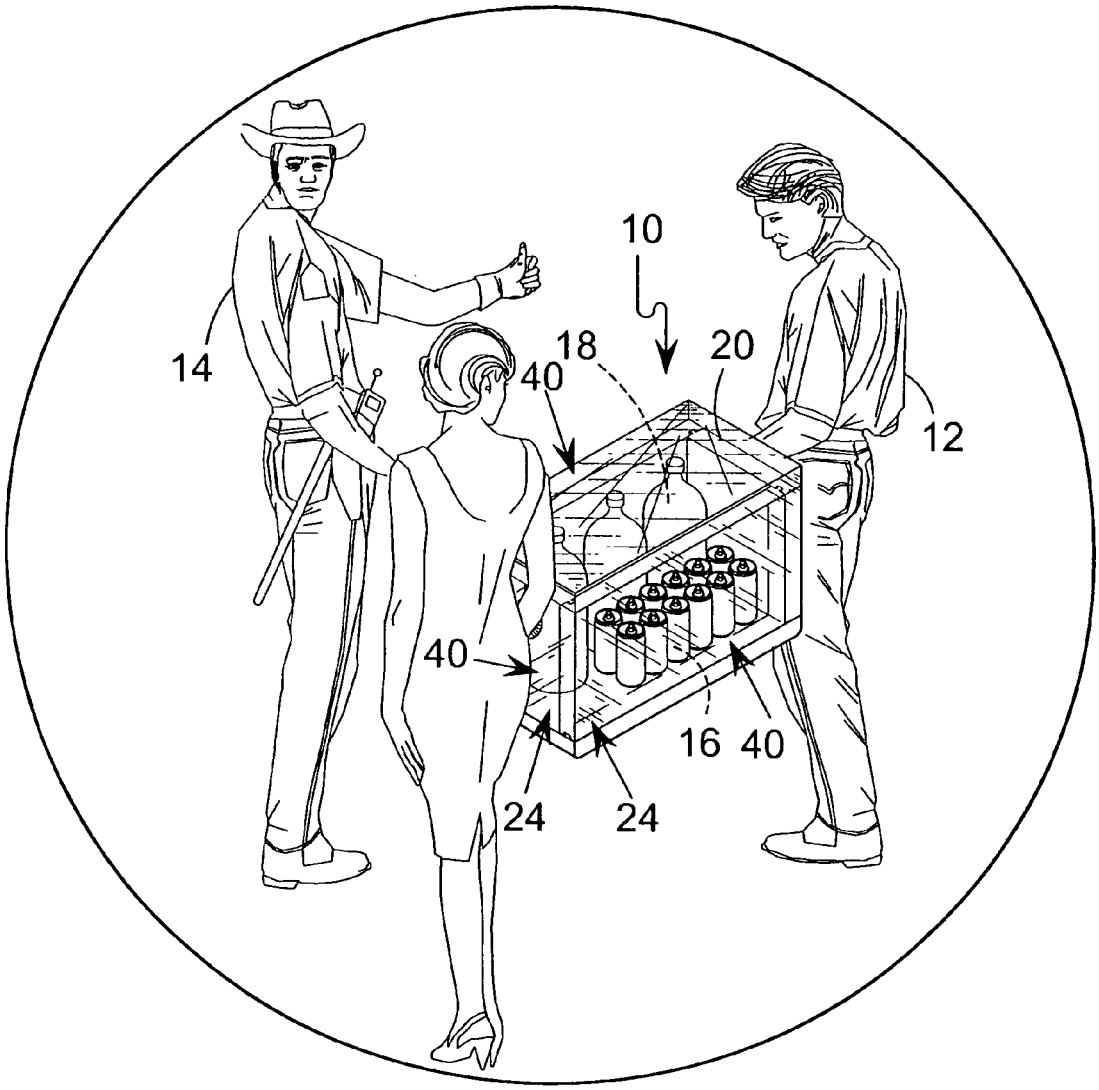
FIG. 1 is an illustrative view of the present invention, a transparent cooler.

Turning now descriptively to the drawings, in which similar reference characters denote similar elements throughout the several views, the figures illustrate the One-Piece Transparent Portable Cooler of the present invention. With regard to the reference numerals used, the following numbering is used throughout the various drawing figures.

10 collapsible transparent cooler
12 user
14 security
16 contents
18 cooler compartment
20 lid
22 base
24 walls
26 air-gap
28 side
30 side
32 end
34 end
36 snap-on cover
38 lock
40 envelope
42 envelope wall
44 envelope recess
46 envelope access aperture
48 T-rail
50 T-rail tabs
52 T-channel
54 T-channel recesses
56 handle
58 lid top surface
60 lid bottom surface
62 lid flange
64 lid flange top surface
66 lid flange interior surface
68 gasket
70 gasket channel
72 lock aperture
74 cover flange
76 cover flange lip
78 wall flange
80 wall flange lip
82 lock spring elements
84 decorative placards
86 handle
88 strap
90 buckle
92 release

DETAILED DESCRIPTION OF THE PREFERRED EMBODIMENTS

The following discussion describes in detail one embodiment of the invention. This discussion should not be construed, however, as limiting the invention to those particular embodiments. Practitioners skilled in the art will recognize numerous other embodiments as well. For a definition of the complete scope of the invention, the reader is directed to the appended claims.

Referring to FIG. 1, depicted is an illustrative view of the present invention, a collapsible transparent cooler (10). The transparent, multi-piece cooler of the present invention (10) provides a portable unit having means to see the contents (16) within the container (10). Each of the side panels (24) and top cover (20) are made of a transparent polymeric or like material. The transparency allows the user (12) to see the contents (16) without opening the cover (20). This is particularly useful for security (14) inspections at sporting events and other controlled activities. The present invention (10) also provides means for shielding the contents (16) of the cooler (20) from direct sunlight by positioning on the exterior surface of each of the walls (24) and cover (20) an envelope (40) comprised substantially of a spaced apart wall of negligible thickness for inserting within said space a protective element to shield the interior (18) from direct sunlight. In addition, the collapsible transparent portable cooler (10) can be disassembled for storage purposes.

Figure 2:
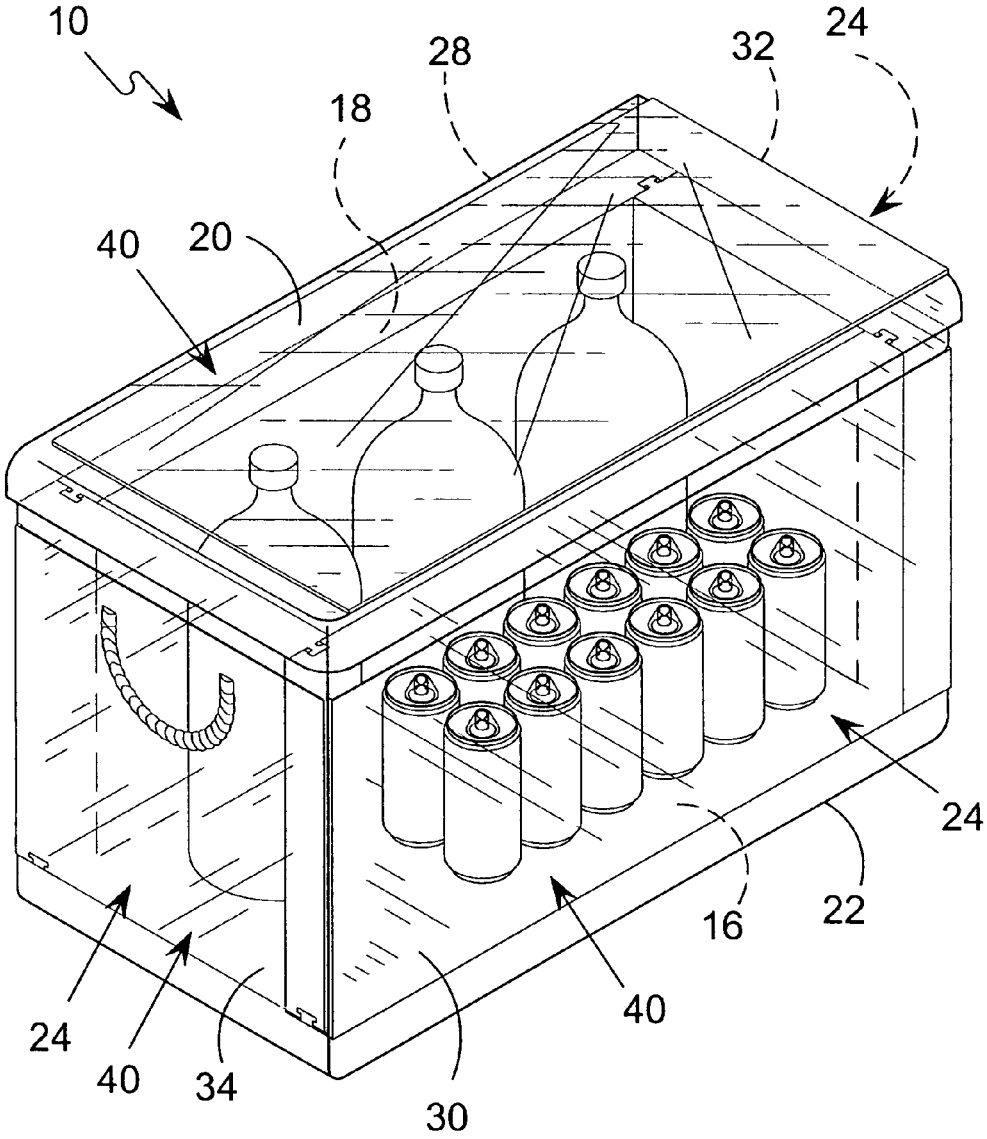
FIG. 2 is an isometric view of the transparent cooler of the present invention.

Referring to FIG. 2, illustrated is an isometric view of the transparent cooler of the present invention (10). Shown is the present invention having contents (16) within the transparent cooler (10). The transparency allows the user (12) to see the contents (16) without opening the cover (20). The side panels (24) are removable allowing the cooler (10) to be disassembled for storage or for ease of cleaning. The transparent cooler (10) is comprised of a removable cover (20) that engages the side walls (28, 30) and end walls (32, 34) which slidably engage each other and the base (22) to form a cooler compartment (18) for the transport therein of food and beverage items (16) which are clearly visible from the exterior of the cooler without having to remove the cover (20). The advantage of transparency is that the coolers (10) can be visually scanned without having to stop and open the cooler (10). Since many stadium events have crowds in the tens of thousands, large opaque containers have been banned in some instances due to time and personnel limitation. The present invention (10) provides means for scanning the contents (16) in a fluid movement. Much in the same way as tickets are collected at the gate. It should also be noted that since the walls (24) and cover (20) are transparent, that even indoor events having low light, the contents would still be viewable as opposed to a cooler having a transparent top or walls providing partial transparency. Each of the side (28, 30) and end walls (32, 34), in addition to the cover (20) have a spaced apart wall forming an envelope (40) for the insertion therein of user selective decorative or protective elements that would prevent the contents (16) from being exposed to direct sunlight and can easily be removed and reinserted as the need arises.

Figure 3:
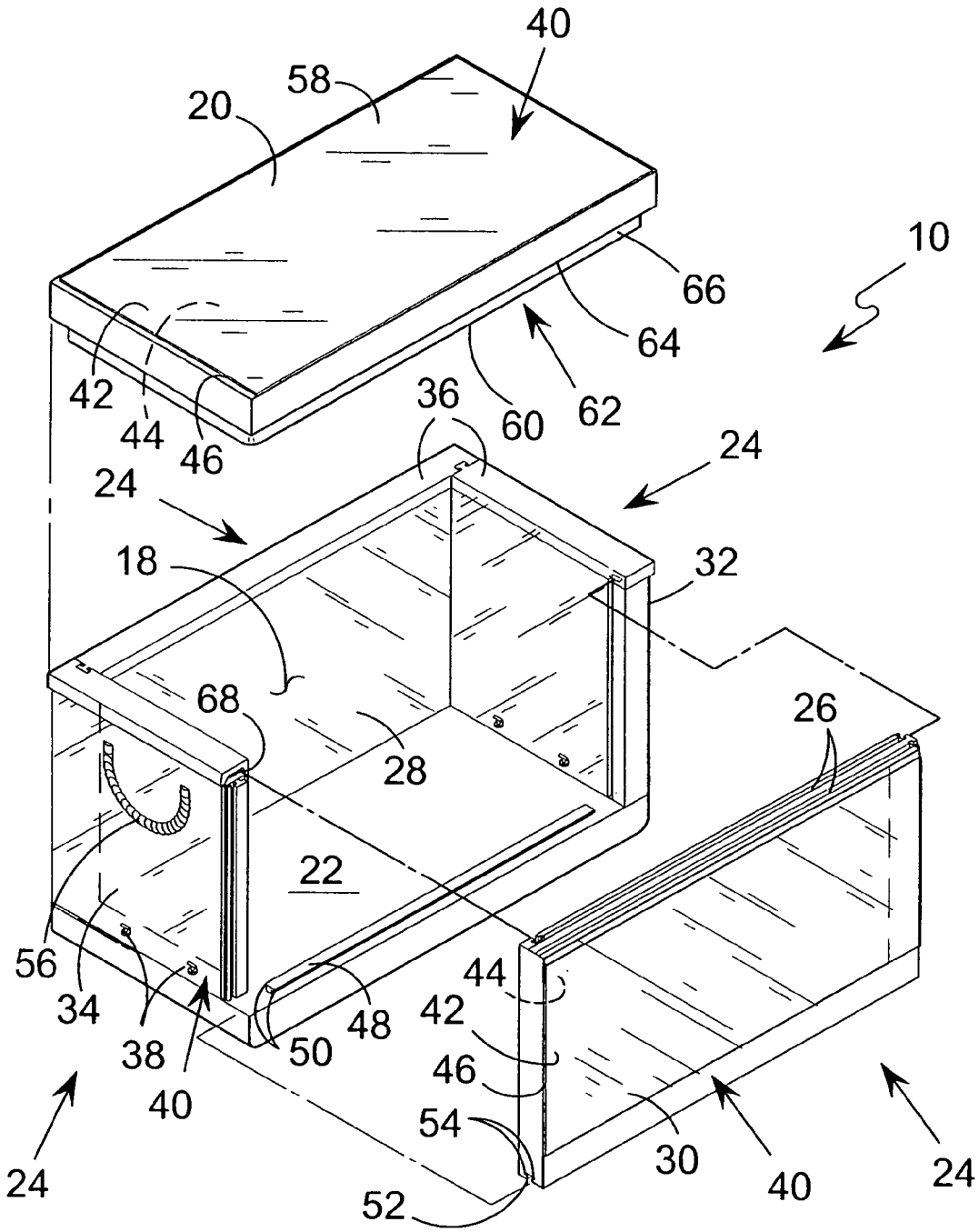
FIG. 3 is a partially exploded view of the transparent cooler of the present invention.

Referring to FIG. 3, shown is a partially exploded view of the transparent cooler of the present invention (10). Shown is the present invention having multiple elements comprising the transparent cooler. The side walls (28, 30) and base (22) are connected and sealed by means of T-tracks (48) and T-channels (52) having gasket seals (68). The side panels (24) are removable allowing the cooler to be disassembled for storage or for ease of cleaning. As previously stated, the present invention is a plurality of planar transparent elements comprised of a lid (20) having a top side (58) and a bottom side (60) with a flange (62) circumferentially positioned having top surface (64) and interior surface (66) for engaging and sealing the lid (20) to the walls (24). The top surface (58) of lid (20) is a spaced apart wall (42) creating envelope recess (44) with envelope access aperture (46) whereby the user can insert element to block direct sunlight from the interior (18). Lid flange (62) engages the walls (24) snap-on cover (36). Each of the side walls (28, 30) and end walls (32, 34) are manufactured in the preferred embodiment in a similar manner to reduce costs in production but is not limited to such. This being the case, a description of one infers a description for all. As an insulative factor the walls (24) are comprised of two or more spaced apart plates forming at least one air-gap (26) acting as a thermal barrier. On the exterior side there is another spaced apart plate of negligible thickness acting as an envelope (40) creating recess (44) with access aperture (46) whereby a user can insert decorative placards that can be related to the event being attended. The placards can be easily removed through access aperture (46) providing a visually transparent cooler (10) and placed back into their respective recesses (44) to shield the interior (18) from direct sunlight. On the interior side of the walls is a T-channel (52) with a T-rail (48) located on the opposing distal end. The T-rail of one wall (24) is mated with the T-channel of an opposing wall (24) thereby forming spaced apart side walls (28, 30) and end walls (32, 34). The base of each wall (24) has a longitudinally extending T-channel (52) with the end wall T-channels forming a receiving element for the locks (38). Once the side walls (28, 30) and end walls (32,34) are assembled by engaging the T-rails (48) into mating T-channels (52), the snap-on covers (36) are placed over the wall (24) edges sealing the air-gaps (26) whereupon the wall assembly is slid across the base (22) until the base (22) T-rails (48) are encompassed by the side walls (28,30) T-channels. Once positioned, the locks (38) are extended until seated within their respective end wall (32, 34) T-channels thereby creating a structurally sound transparent cooler (10). Handles (56) can be used to aid in the portability of the cooler (10) or other appropriate support means as disclosed in other drawings. Any assembly steps herein described are for descriptive purposes as there are other methods of assembly at the user's discretion.

Figure 4:
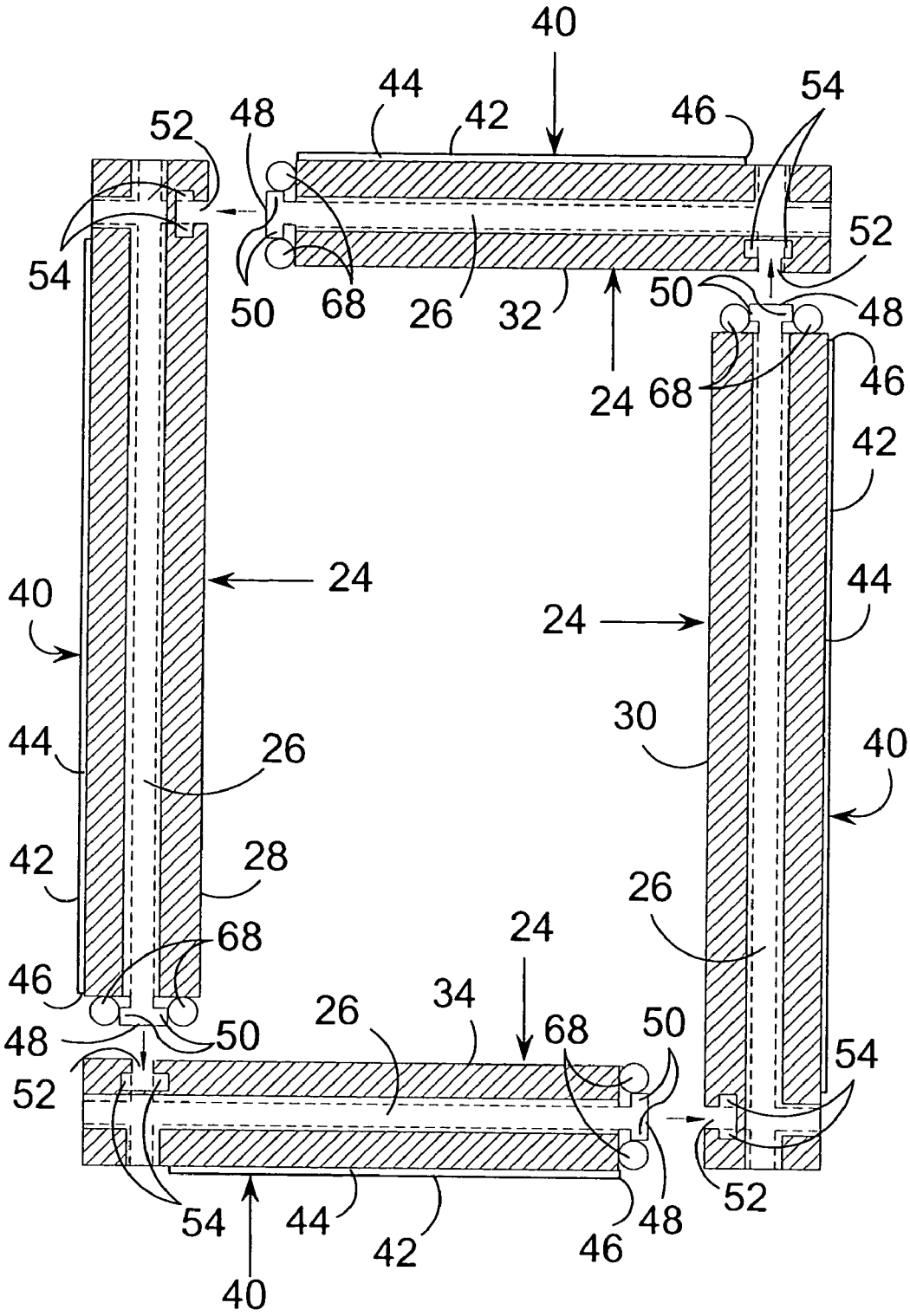
FIG. 4 is a top exploded view of the walls of the present invention.

Referring to FIG. 4, depicted is a top exploded view of the walls (24) of the present invention (10). Shown is a bottom edge view of the spaced apart walls (24) wherein each wall forms a corner on one distal end while abutting the next adjacent wall. Once assembled the walls form a rigid structure. Also shown in dotted line are the channels on the opposing edge of the side walls (26, 30) that are mounted onto the T-track (48) of the base (22). Each of the side walls (28, 30) as illustrated in comprised of spaced apart plates (24) wherein said space forms insulation (26) between the spaced apart plates. It should also be noted that a third spaced apart plate (42) on the exterior side having negligible thickness and space can be used for housing advertisement, logos, pictures, art or any conceivable opaque material that can be used to seal the cooler (10) from the rays of the sun. The side walls (28, 30) and end walls (32, 34) are manufactured in the preferred embodiment in a similar manner to reduce costs in production but is not limited to such. As shown the walls (24) are comprised of two or more spaced apart plates forming at least one air-gap (26) acting as a thermal barrier. On the exterior side there is another spaced apart plate of negligible thickness acting as an envelope (40) creating recess (44) with access aperture (46) whereby a user can insert decorative placards that can be related to the event being attended. The placards can be easily removed through access aperture (46) providing a visually transparent cooler (10) and placed back into their respective recesses (44). On the interior side of the walls is a T-channel (52) with a T-rail (48) located on the opposing distal end having gasket (68) providing means for sealing the adjacent walls (24). The T-rail of one wall (24) is mated with the T-channel of an opposing wall (24) thereby forming spaced apart side walls (28, 30) and end walls (32, 34).

Figure 5:
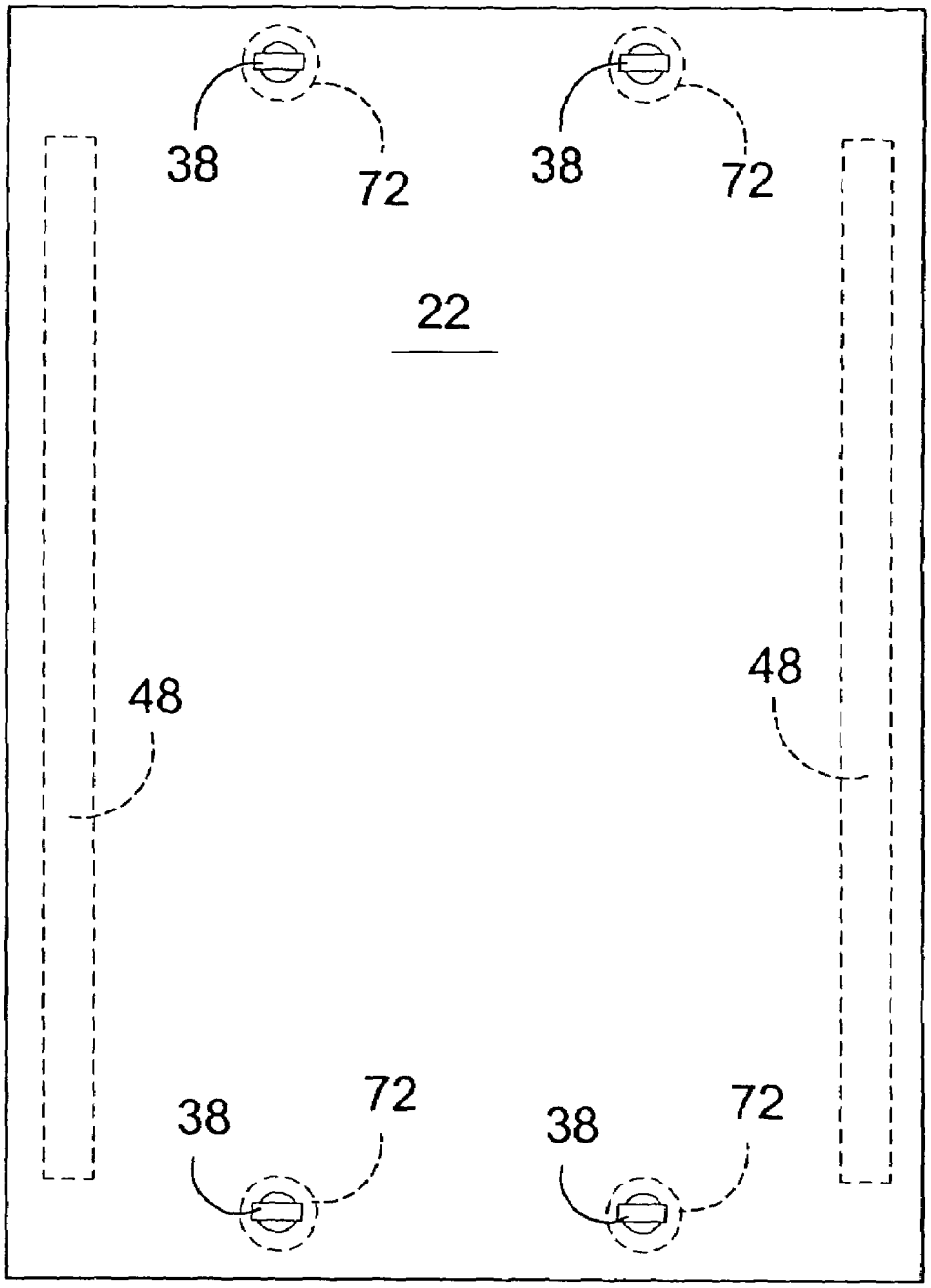
FIG. 5 is a bottom view of the base of the present invention.

Referring to FIG. 5, illustrated is a bottom view of the base (22) of the present invention. Shown are the T-tracks (48) on opposite sides, when the four side walls (24) are assembled, and securely put together, they slide on the base (22) T-tracks (48) and are secured through holes (72) in the base (22) by means of locks (38). The side walls (28, 30) and end walls (32,34) are assembled by engaging the T-rails (48) into mating T-channels (52) with the snap-on covers (36) placed over the wall (24) edges sealing the air-gaps (26) whereupon the wall assembly is slid across the base (22) until the base (22) T-rails (48) are encompassed by the side walls (28,30) T-channels. Once positioned, the locks (38) are extended through lock aperture (72) until seated within their respective end wall (32, 34) T-channels thereby preventing side walls (28, 30) from moving along the base T-rails. Disassembly occurs by rotating the locks (38) until they disengage from their respective end wall (32, 34) T-channels whereupon side walls (28, 30) can be slidably disengaged from base (22) T-rails. The side walls (28, 30) and end walls (32, 34) can then be slidably disengaged from each other thereby providing the collapsed state of the transparent cooler (10) of the present invention.

Figure 6:
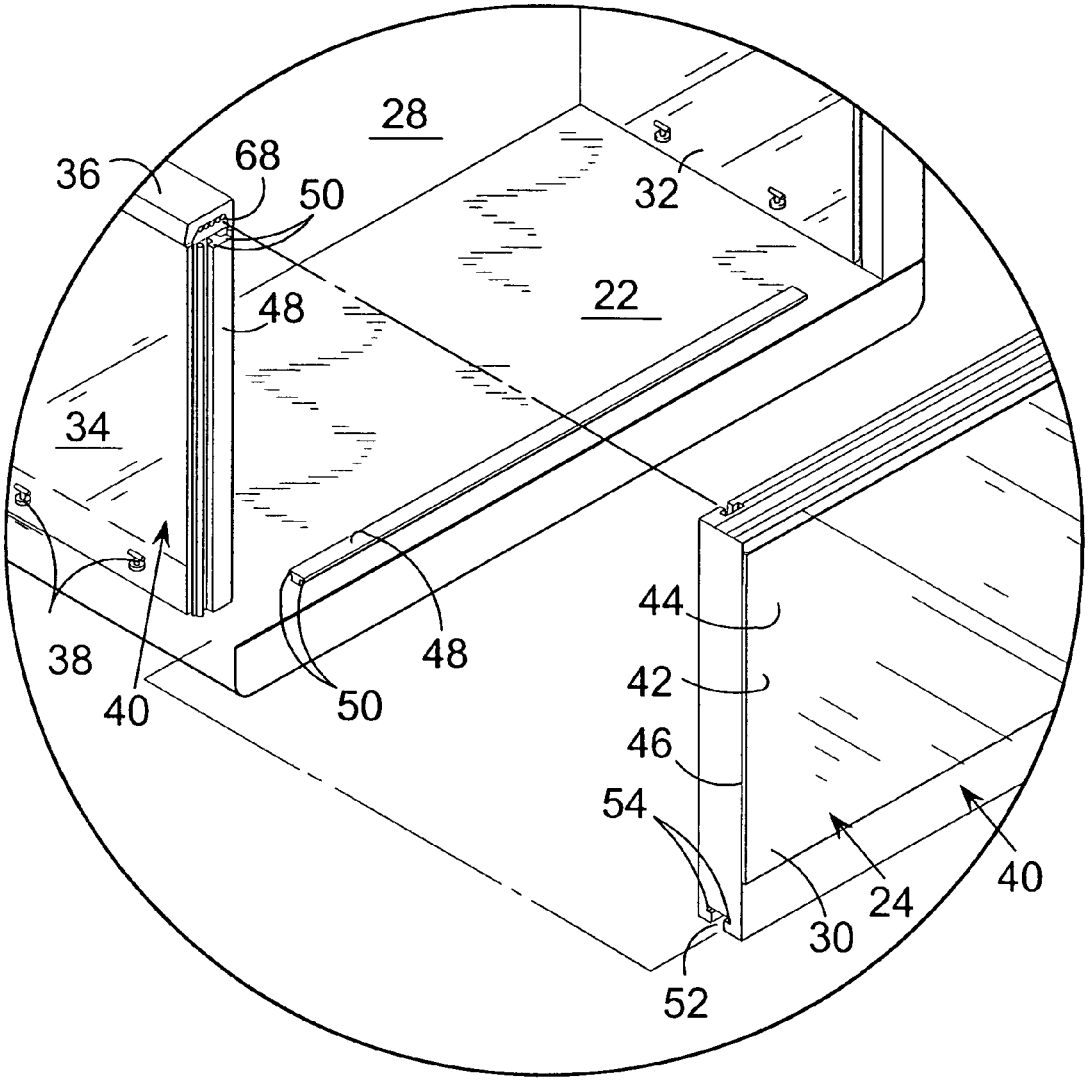
FIG. 6 is a detailed view of the present invention.

Referring to FIG. 6 shown is a detailed view of the present invention. Shown are the T-channels (52) and T-tracks (48) having rope seals (68) for a secure assembly of the four walls (24) and base (22) members. When the four side walls (24) are assembled, and securely put together, they slide on the base (22) T-tracks (48) and are secured through holes (72) in the base (22) by means of locks (38). The side walls (28, 30) and base (22) are connected and sealed by means of T-tracks (48) having T-rail tabs (50) which conform substantially in size to T-channels (52) with T-channel recesses (54). The gasket seals (68) seals the interior from liquid seepage. The side walls (28, 30) and end walls (32, 34) are manufactured in the preferred embodiment in a similar manner to reduce costs in production but are not limited to such. The spaced apart walls (24) are comprised of two or more spaced apart plates forming at least one air-gap (26) acting as a thermal barrier. On the exterior side there is another spaced apart plate of negligible thickness acting as an envelope (40) creating recess (44) with access aperture (46) whereby a user can insert decorative placards that can be related to the event being attended. The placards can be easily removed through access aperture (46) providing a visually transparent cooler (10) and placed back into their respective recesses (44) to shield the interior (18) from direct sunlight. On the interior side of the walls is a T-channel (52) with a T-rail (48) located on the opposing distal end. The T-rail of one wall (24) is mated with the T-channel of an opposing wall (24) thereby forming spaced apart side walls (28, 30) and end walls (32, 34). The base of each wall (24) has a longitudinally extending T-channel (52) with the end wall T-channels forming a receiving element for the locks (38). Once the side walls (28, 30) and end walls (32,34) are assembled by engaging the T-rails (48) into mating T-channels (52), the snap-on covers (36) are placed over the wall (24) edges sealing the air-gaps (26) whereupon the wall assembly is moved to slidably engage the base (22) until the base (22) T-rails (48) are encompassed by the side walls (28,30) T-channels. Once positioned, the locks (38) are extended through lock apertures (72) until seated within their respective end wall (32, 34) T-channels thereby creating a structurally sound transparent cooler (10).

Figure 7:
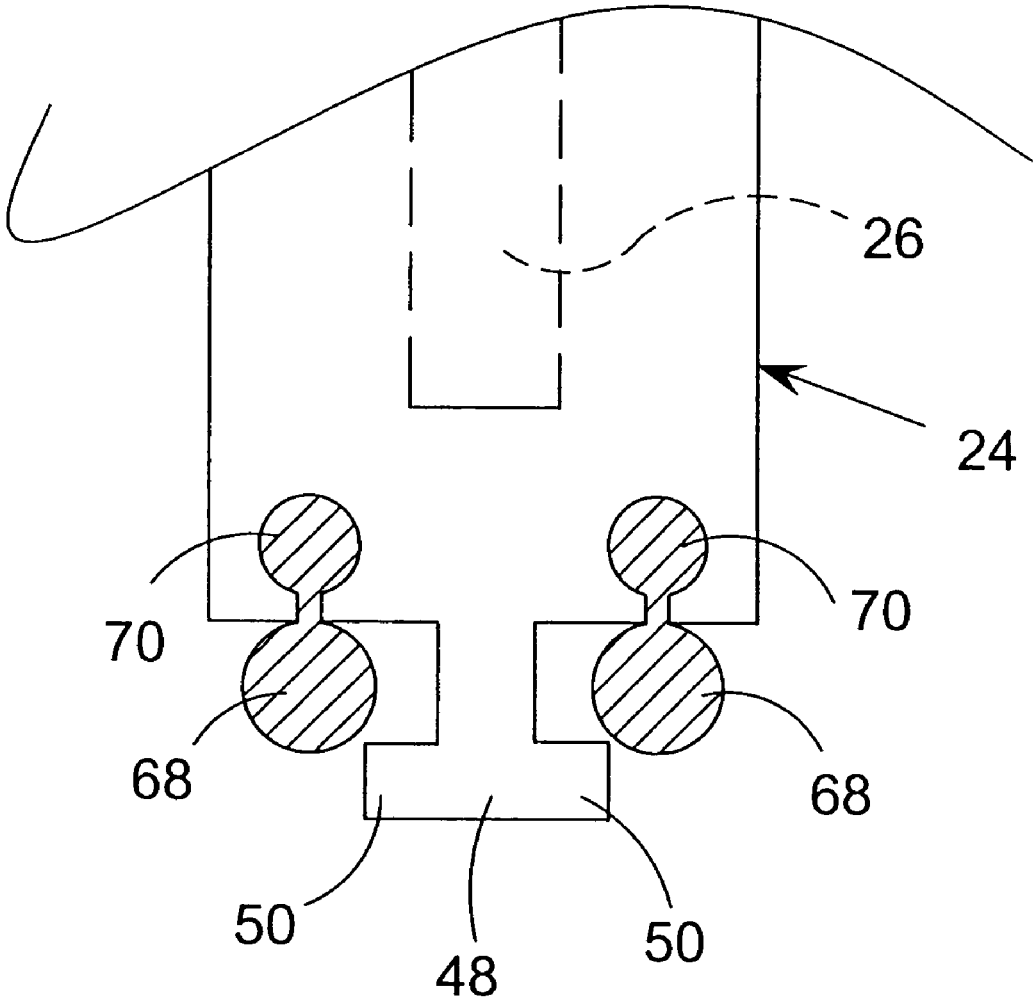
FIG. 7 is an enlarged partial view of the gasket of the present invention.

Referring to FIG. 7, shown is an enlarged partial view of the gasket (68) of the present invention. The gasket (68) is comprised of suitable resilient material that is positioned on the T-track (48) side of each panel (24) and continues along the bottom of the panels. The function of the gaskets (68) to seal the seams of the container (10). The end wall and bottom of each panel (24) is extruded to accept the gasket (68), which securely fastens the gasket to the walls (24). The side walls (28, 30) and end walls (32, 34) have one end with a T-track (48) with T-track tabs (50) which conform substantially in size and shape with the T-channels (52) having T-channel recesses (54). The gaskets (68) have a gasket channel (70) as a retaining element for the gasket (68). When the T-tracks (48) and T-channels (52) are mated the gaskets will be compressed forming a watertight seal between the adjacent walls (24).

Figure 8:
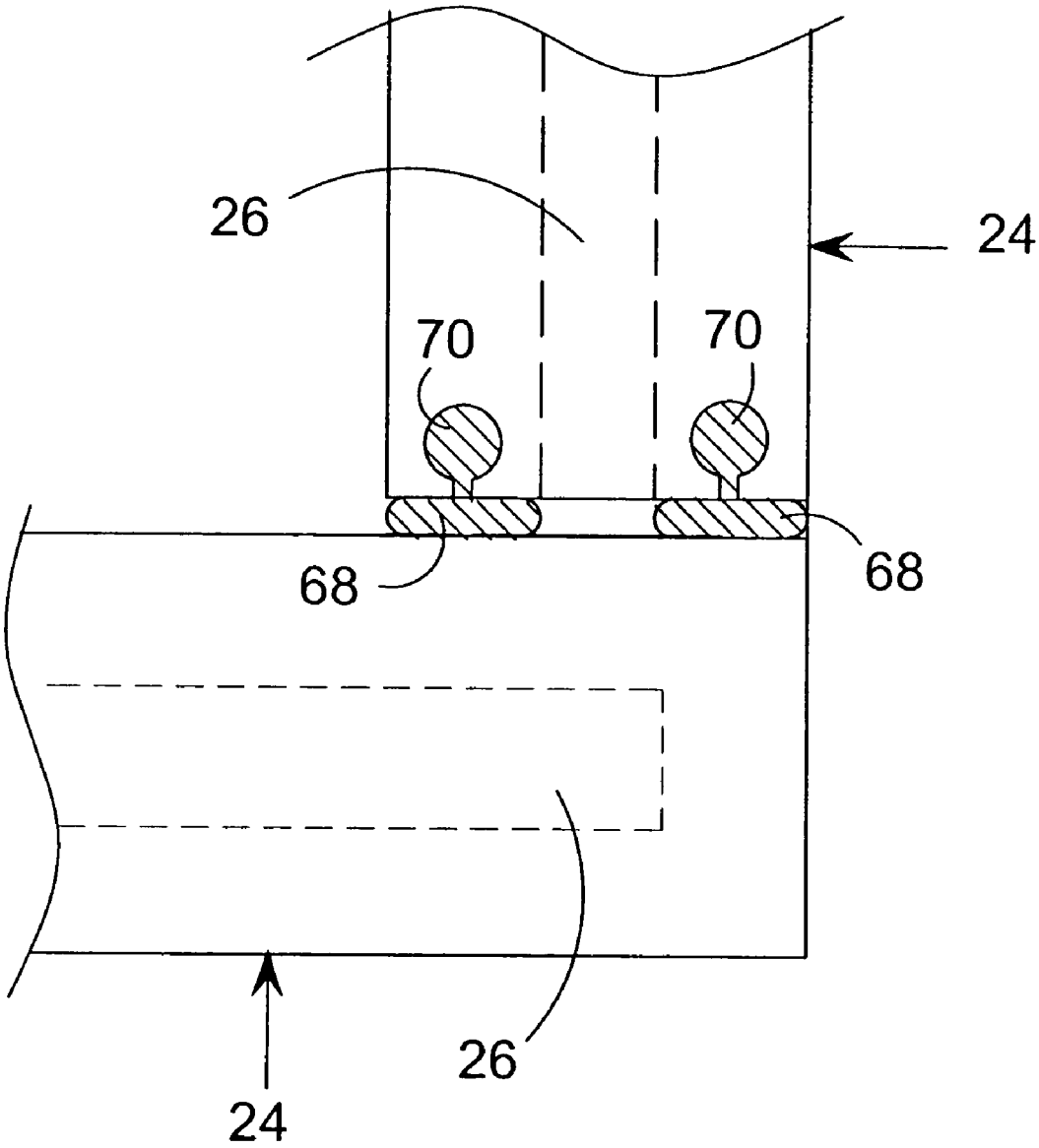
FIG. 8 is a top partial edge view of mated walls of the present invention.

Referring to FIG. 8, shown is a top partial edge view of mated walls (24) of the present invention. The mated edges of the walls (24) have a compressed gaskets (68) positioned therebetween creating a double seal seam. The side walls (28, 30) and end walls (32, 34) have one end with a T-track (48) with T-track tabs (50) which conform substantially in size and shape with the T-channels (52) having T-channel recesses (54). The gaskets (68) have a gasket channel (70) as a retaining element for the gasket (68). When the T-tracks (48) and T-channels (52) are mated the gaskets will be compressed forming a watertight seal between the adjacent walls (24).

Figure 9:
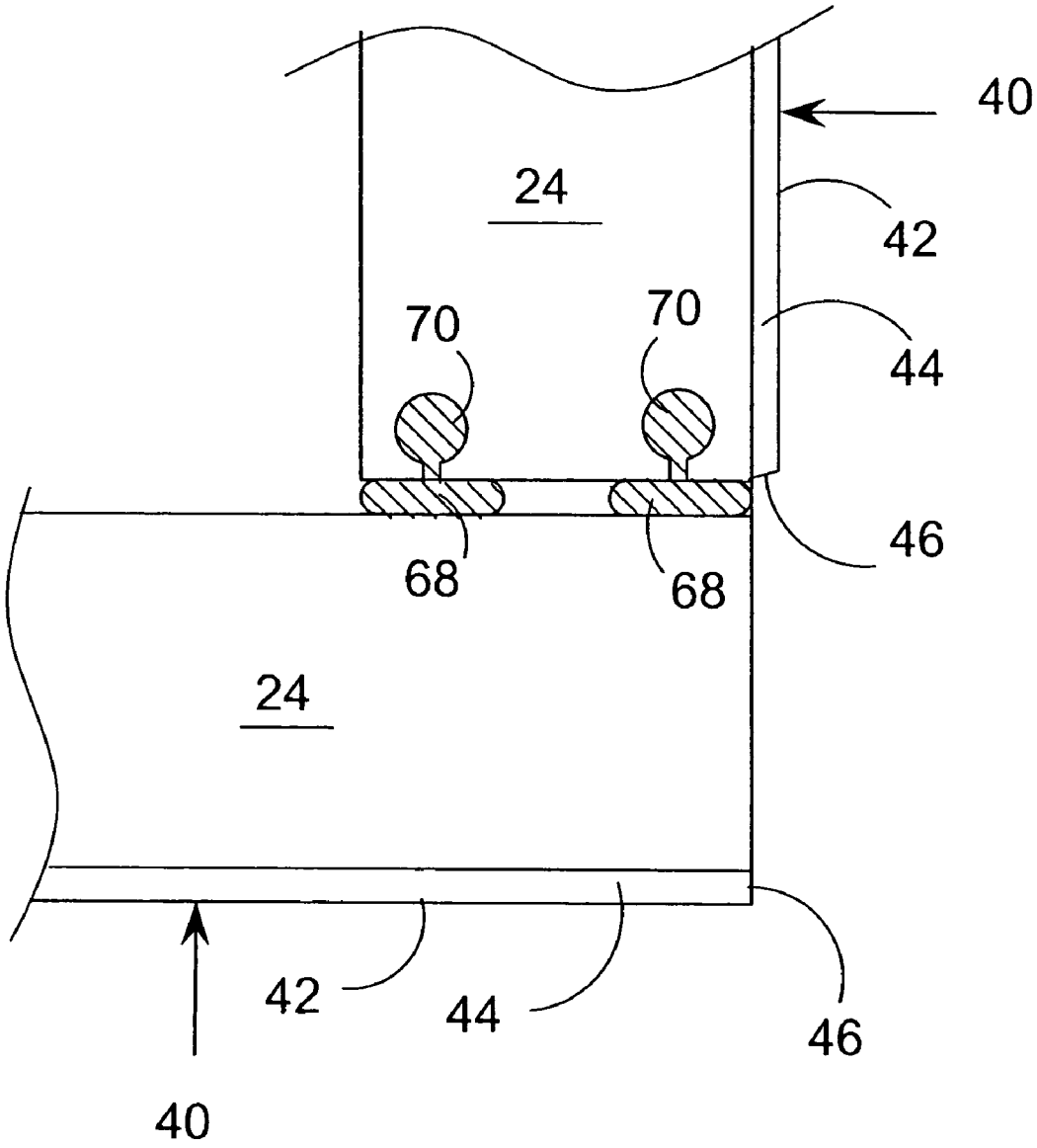
FIG. 9 is a solid wall view of mated walls of the present invention.

Referring to FIG. 9, shown is a solid wall view of mated walls of the present invention. Shown are mated edges of the walls (24) having compressed gaskets (70) positioned therebetween creating a double seal seam. The side walls (28, 30) and end walls (32, 34) have one end with a T-track (48) with T-track tabs (50) which conform substantially in size and shape with the T-channels (52) having T-channel recesses (54). The gaskets (68) have a gasket channel (70) as a retaining element for the gasket (68). When the T-tracks (48) and T-channels (52) are mated the gaskets will be compressed forming a watertight seal between the adjacent walls (24).

Figure 10:
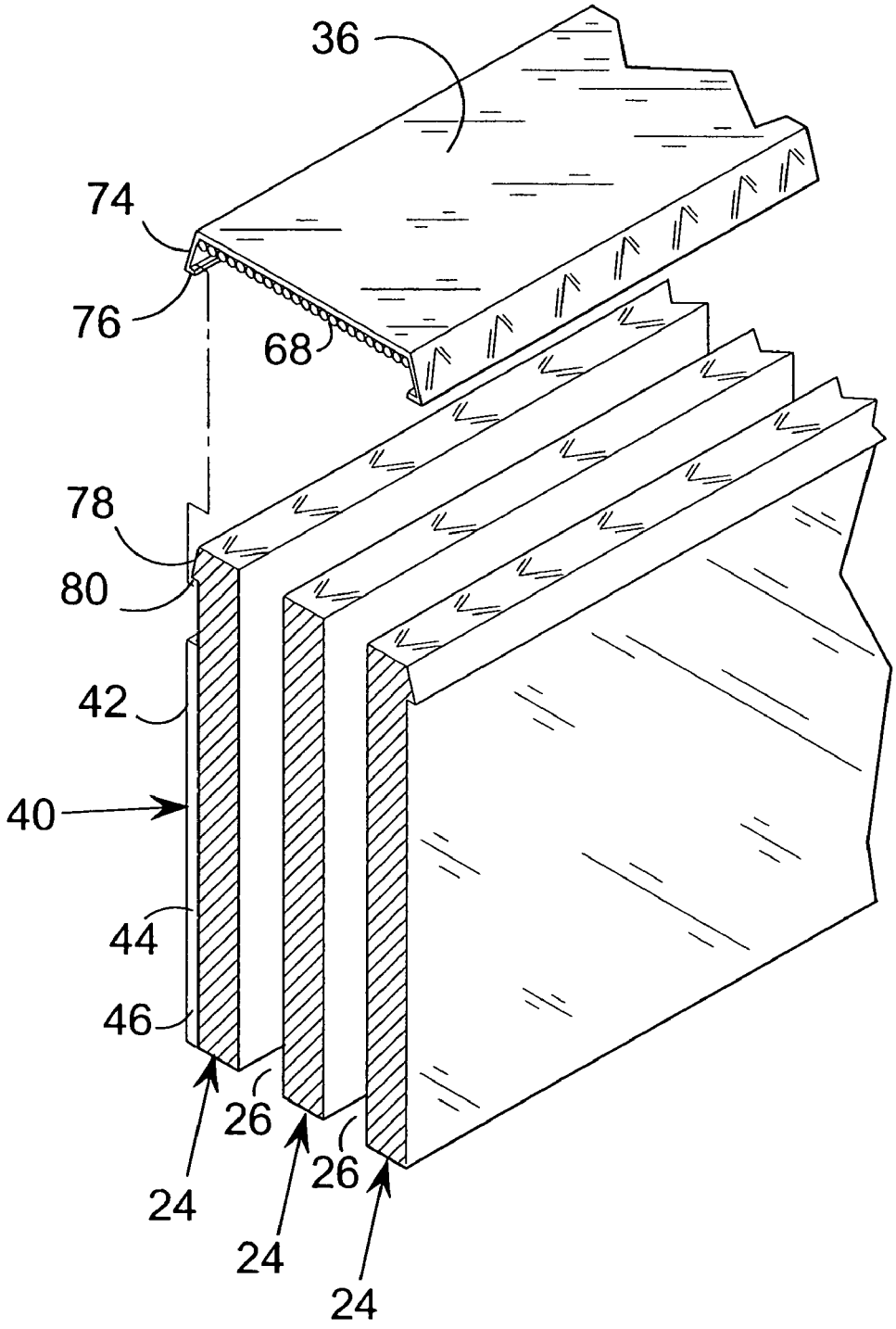
FIG. 10 is a perspective cutaway view of mated walls and snap on cover of the present invention.

Referring to FIG. 10, shown is a perspective cutaway view of mated walls (24) and snap on cover (36) of the present invention. Shown are the panels (24), air gaps (26) and snap on cover (36) that seals the panels having compressed gaskets (68) positioned therebetween creating a double seal seam providing insulation qualities.

Figure 11:
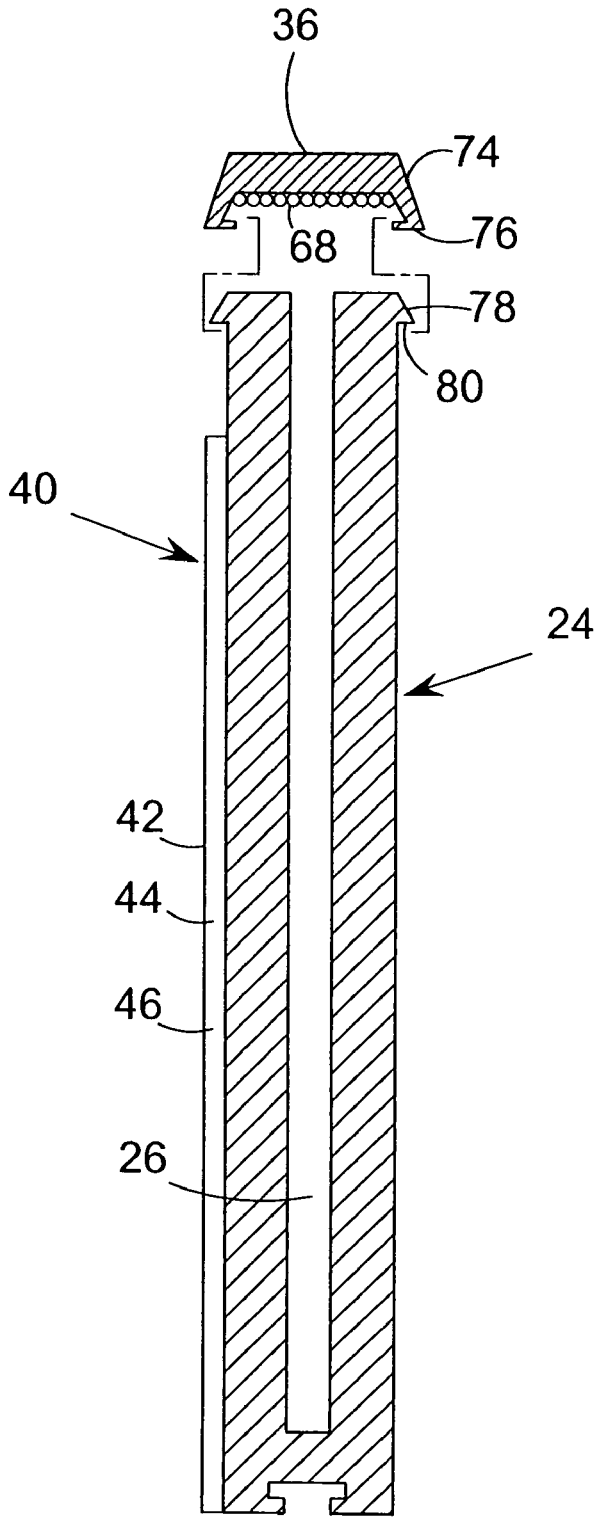
FIG. 11 is a sectional view of a wall having an additional element therein.

Referring to FIG. 11, shown is a sectional view of a wall (26) having an additional element therein. Depicted is a sectional view with an alternate construction of walls (26) having a space (44) on the exterior wall (42) for inserting an opaque material such as a logo, picture, or interchangeable decorative coverings, etc, that will form a sun block material. Also shown is an air gap (26) forming the function of insulation. Also shown is the snap on cover (36) or rail having a seal to close off the top air gap (36).

Figure 12:
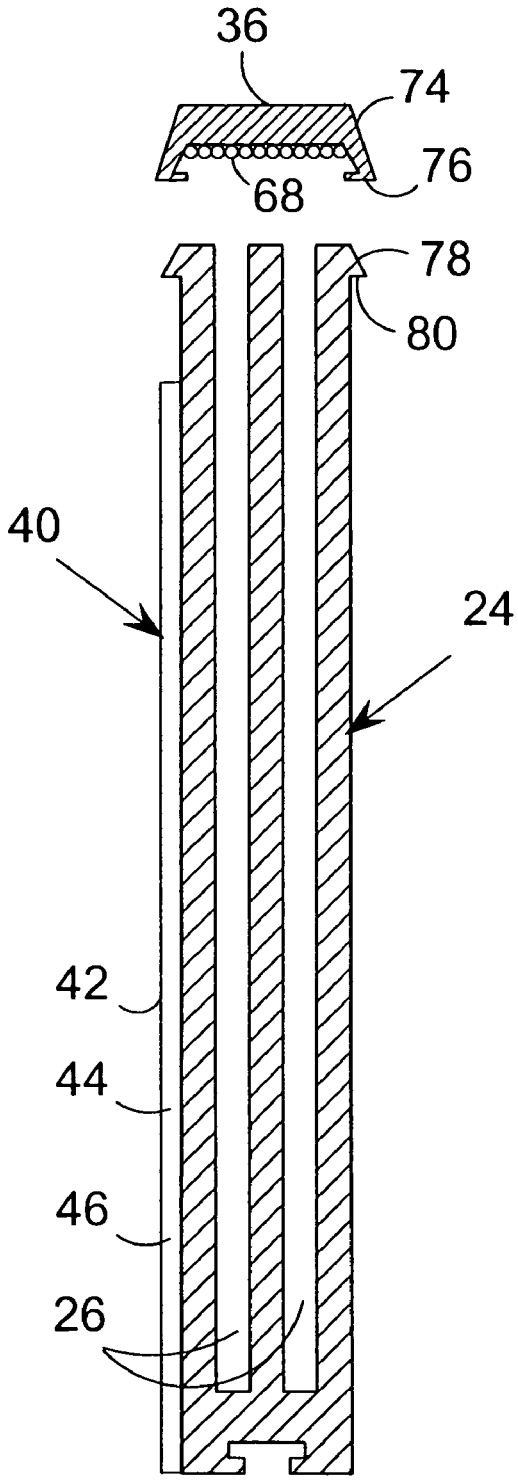
FIG. 12 is a sectional view of the transparent cooler wall with an alternate wall construction.

Referring to FIG. 12, shown is a sectional view of the transparent cooler wall (24) with an alternate wall construction. Depicted is a sectional view with an alternate construction of the end and side walls (28, 30, 32, 34). The transparent polymeric or like material is extruded to include a pair of air gaps (26) between the inner surfaces and an exterior gap. The air gaps (26) form the function of insulation. Also shown is the snap on cover (36) having rope or rubber seals (68) to close off the top air gap.

Figure 13:
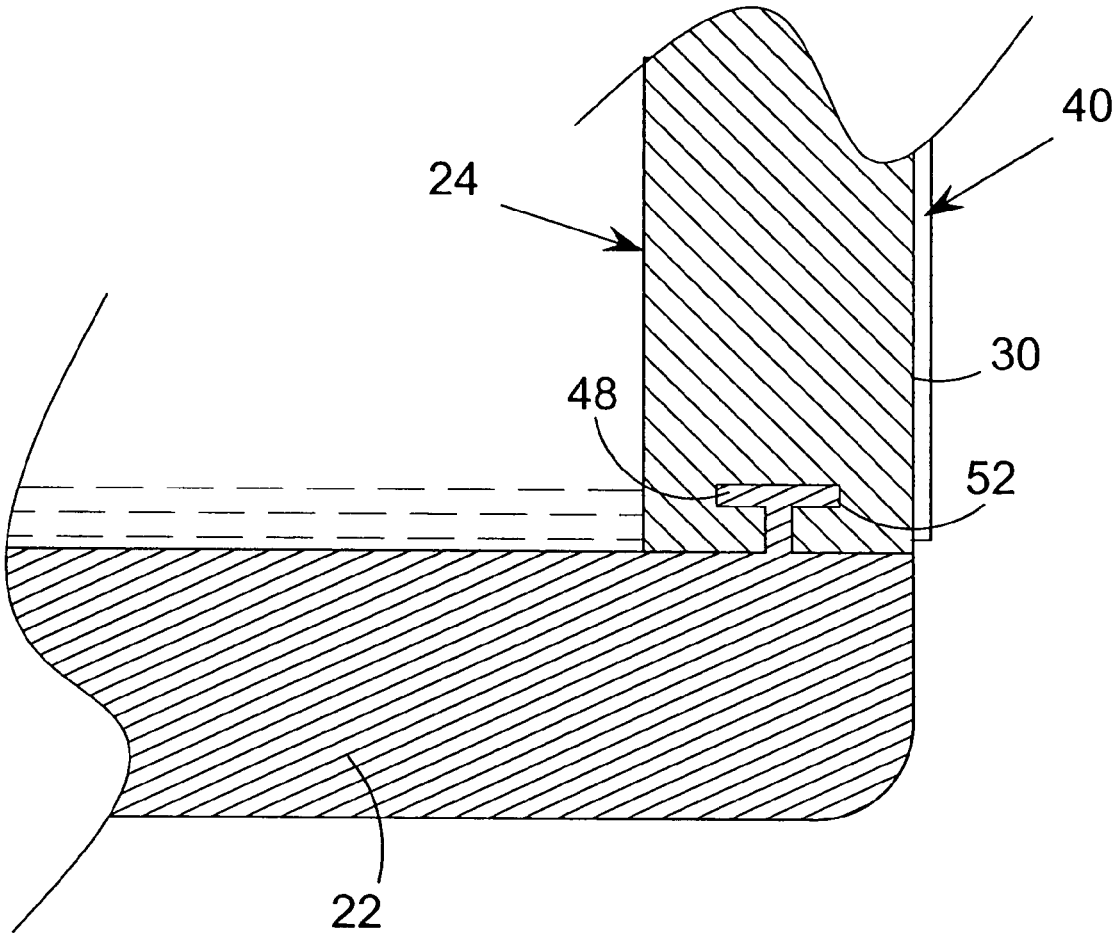
FIG. 13 is a partial view of the base and side wall.

Referring to FIG. 13, shown is a partial view of the base (22) and side wall (28, 30). The base (22) of the present invention has spaced apart T-tracks (48) on opposing sides that mate with T-channels (52) extending the length of the side walls (28, 30). The first step in assembling the cooler (10) is to engage all four sides (28, 30, 32, 34) in each T-channel (52) and T-track (48), then slide the assembly onto the base (22).

Figure 14:
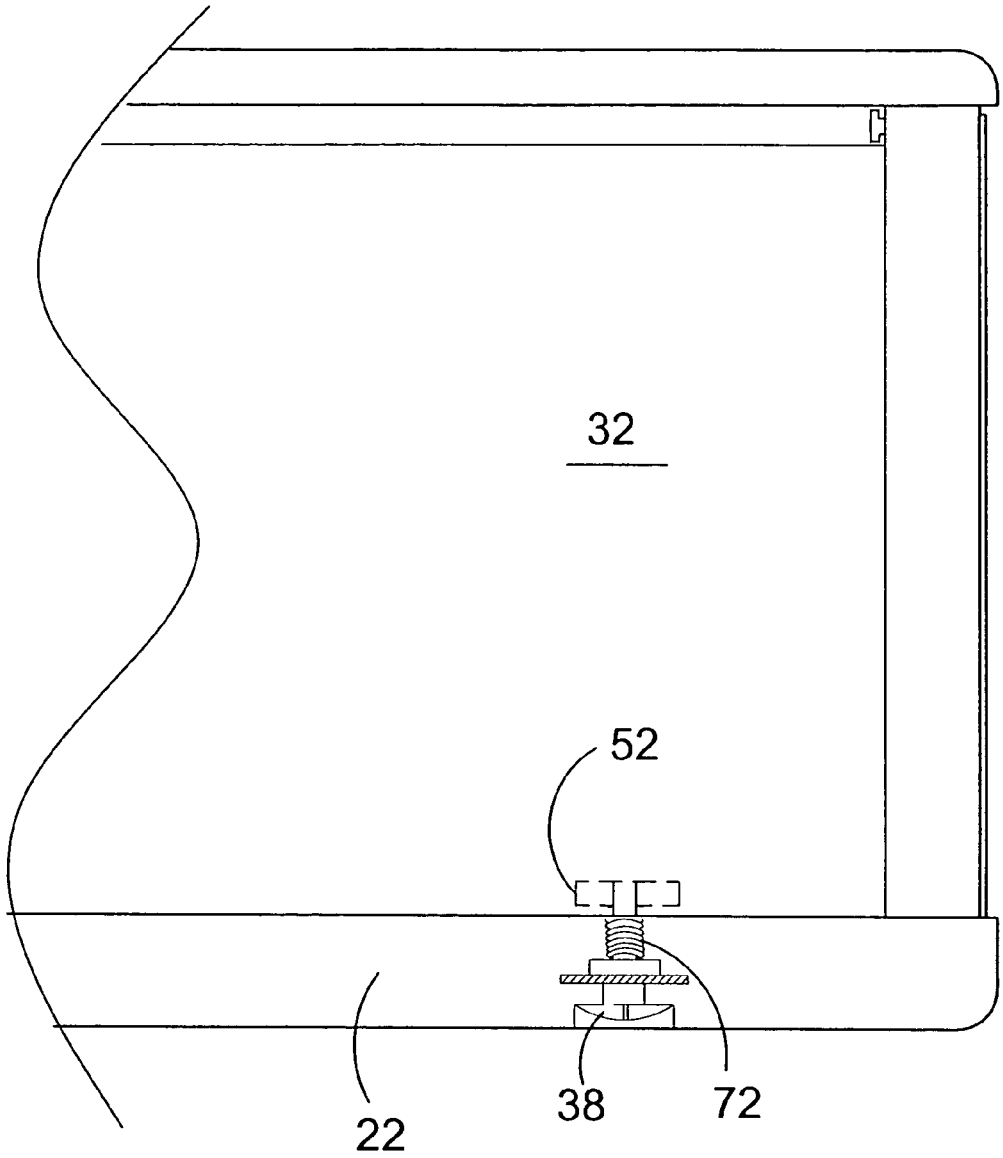
FIG. 14 is a partial side view of the base-locking element.

Referring to FIG. 14, shown is a partial side view of the base (22)-locking element. Shown is the locking element (38) comprised of a member that can be inserted into the T-channel (52) and then rotated to engage the channel. The spring element (82) maintains a consistent pressure upon the locking element as well as returning the locking element to a non-channel engaging position when rotated. When the four wall panels (28, 30, 32, 34) are in place, the four locks (38) are engaged.

Figure 15:
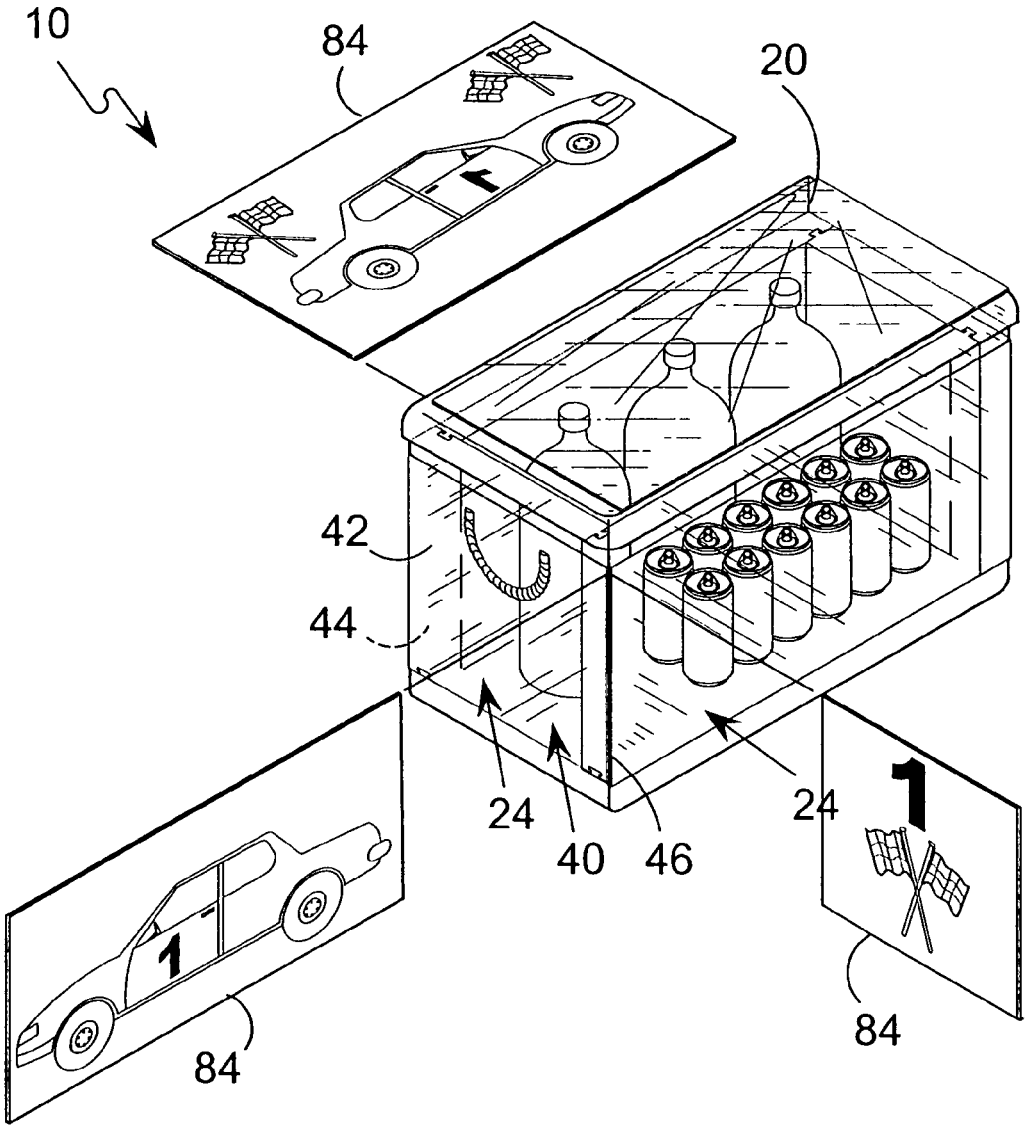
FIG. 15 is an isometric view of the transparent cooler with decorative panel inserts.

Referring to FIG. 15, shown is an isometric view of the transparent cooler 10) with decorative panel inserts (84). With the air gap (44) construction of the end and side walls (28, 30, 32, 34), the air gap (44) provides means to add insulated materials and/or interchangeable decorative coverings (84). The decorative covering (84) can be interchanged to suit the user's activity or event.

Figure 16:
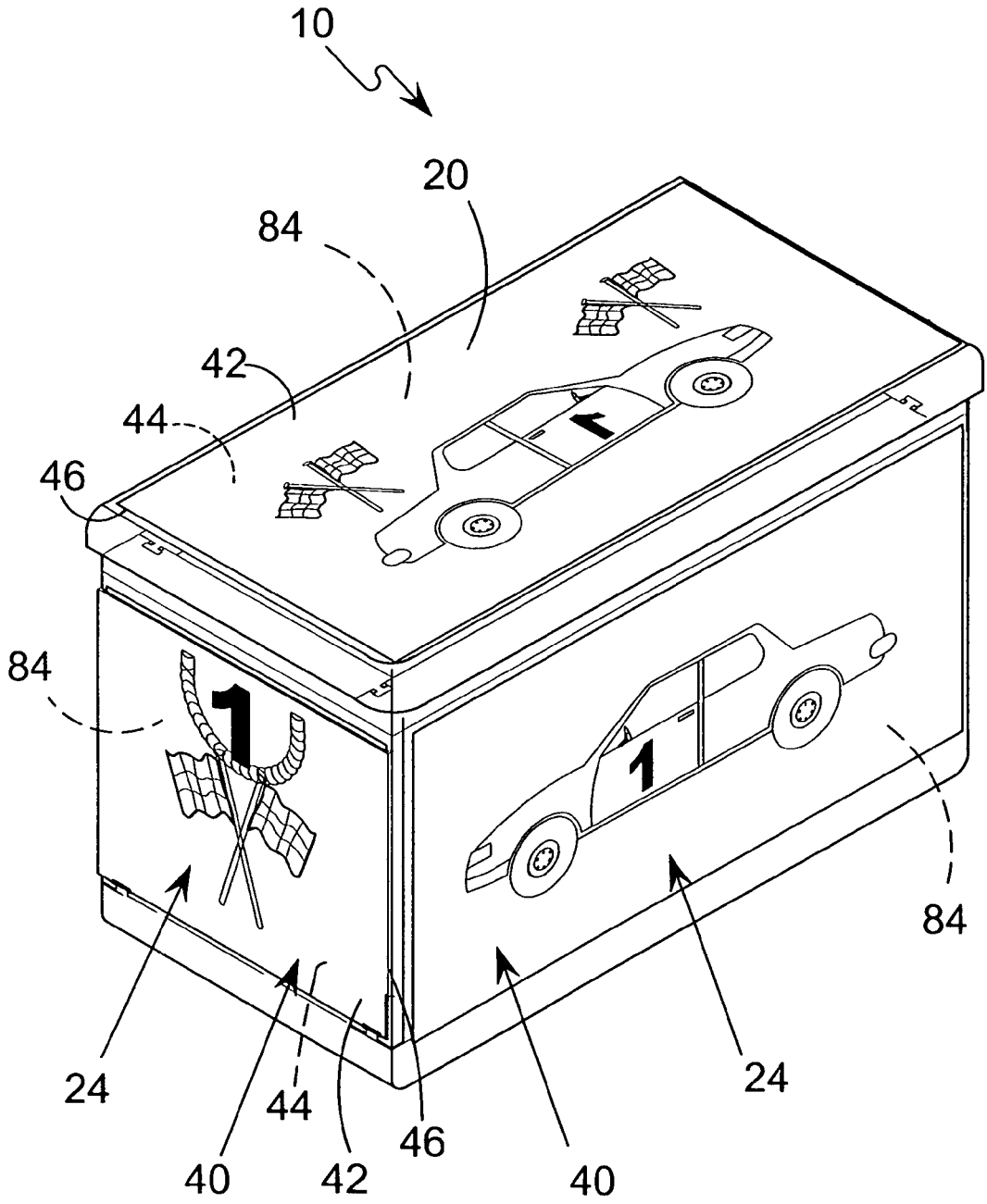
FIG. 16 is an isometric view of the transparent cooler with decorative panel inserts.

Referring to FIG. 16, shown is an isometric view of the transparent cooler (10) with decorative panel inserts (84). With the air gap (44) construction of the end and side walls (28, 30, 32, 34), the air gap (44) provides means to add insulated materials and/or interchangeable decorative coverings (84). The decorative covering (84) can be interchanged to suit the user activity or event.

Figure 17:
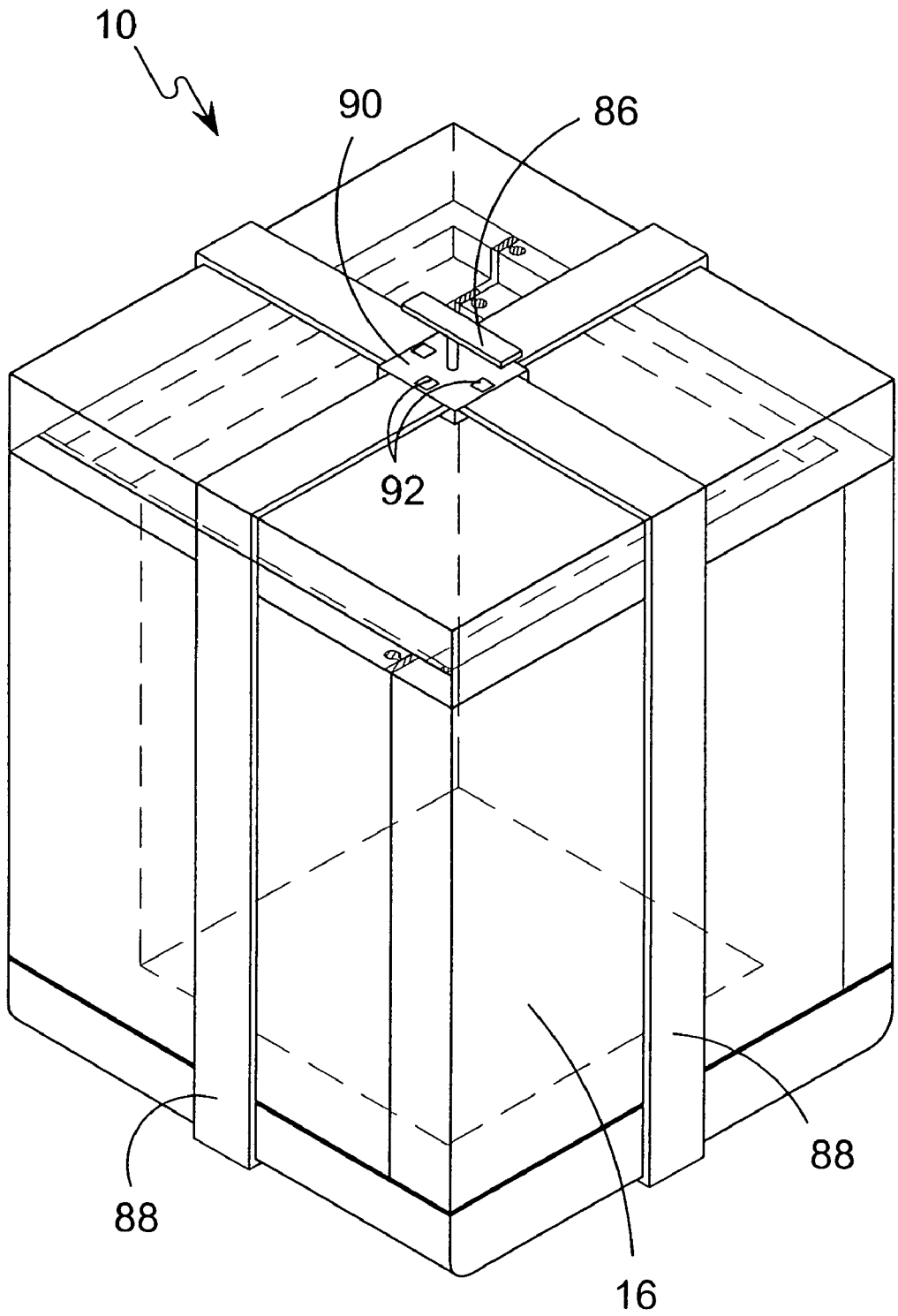
FIG. 17 is an isometric view of the present invention, transparent cooler with alternate lifting means.

Referring to FIG. 17, shown is an isometric view of the present invention, transparent cooler (10) with alternate lifting means (86). An alternate construction of the transparent cooler (10) utilizes a top mounted lifting handle in lieu of end panel handles (56). The handle (86) is supported by adjustable straps (88) that wrap each side and is secured with 4-way receiver (90). The receiver (90) has a release button (92) to enable user access to the cooler (10) contents (16).

What is claimed is new and desired to be protected by Letters Patent is set forth in the appended claims:

1. A cooler having spaced apart walls forming a compartment in communication with a base and a lid wherein said walls and said lid are comprised of transparent planar elements, wherein said base includes:

T-rails depending from a top surface of said on opposing sides thereof, said T-rails are substantially parallel to each other and extend substantially the length of said base; and apertures extending through said base positioned on sides adjacent to said T-rails, said apertures forming receptacles for receiving locking elements having springs for extending and retracting said locking elements and said locking elements can be extended or retracted to engage T-channels longitudinally extending along opposing ends of the base, and wherein said depending T-rails are capable of slidably engaging longitudinally extending T-channels positioned on a bottom edge of opposing sides of said cooler, said slidably engaging T-rails and T-channels are on adjacent sides to said locking elements whereby when said locking elements are engaged the slidably engaging elements are fixedly positioned.

2. The cooler as recited in claim 1, wherein said lid has a peripherally positioned flange having a top surface and an interior surface whereby said flange engages the walls of said cooler.

3. The cooler as recited in claim 1, wherein each of said walls are formed of at least two transparent planar sheets, said transparent planar sheets having a common base wherein said transparent planar sheets are spaced apart and are substantially parallel.

4. The cooler as recited in claim 3, wherein said common base of at least two of said transparent planar sheets have a T-shaped channel extending longitudinally therealong.

5. The cooler as recited in claim 4, wherein each of said walls have an edge extending perpendicular to said common base wherein said edge has a T-rail extending therealong.

6. The cooler as recited in claim 5, wherein said spaced apart walls have an interiorly positioned T-shaped channel extending vertically on the opposing end of said T-shaped rail.

7. The cooler as recited in claim 6, wherein said T-shaped rail of each wall mates with a respective T-shaped channel of an adjacent wall in order to form the exterior walls of said cooler.

8. The cooler as recited in claim 7, wherein one of the transparent planar sheets of each wall forms an exterior side of the cooler wherein said base and top edge are in communication with said exterior side.

9. The cooler as recited in claim 8, wherein said exterior side has an aperture on the opposing ends whereby a placard of substantially similar dimensions can be inserted therein.

10. The cooler as recited in claim 9, wherein said aperture extends between the top edge and base of said wall.

11. The cooler has recited in claim 3, wherein said spaced apart walls are open on a top edge thereof.

12. The cooler has recited in claim 11, wherein one of said transparent planar sheets forms an exterior wall of the cooler and another of said transparent sheets of each wall forms an interior wall of the cooler, and further comprising a first flange extending along an exterior surface of the exterior wall and a second flange extending along an interior surface of the interior wall.

13. The cooler as recited in claim 12, further comprising a cap for covering the opening of said top edge.

14. The cooler as recited in claim 13, wherein said cap has opposing flanges extending the length of the cap.

15. The cooler as recited in claim 14, wherein said opposing flanges of said cap each operatively engage a respective one of the flanges on said exterior and interior walls.

16. The cooler as recited in claim 15, wherein said cap has a plurality of gasket-like elements in engagement with the adjacent gasket-like element are parallel with said flanges.

17. The cooler as recited in claim 16, wherein said plurality of gasket-like elements of said cap are in engagement with the top open edge of said walls forming sealing means for said open space.

* * * * *